United States Patent [19]

Billman

[11] Patent Number: 4,552,425

[45] Date of Patent: Nov. 12, 1985

[54] HIGH CURRENT CONNECTOR

[75] Inventor: Timothy B. Billman, Carlisle, Pa.

[73] Assignee: AMP Incorporated, Harrisburg, Pa.

[21] Appl. No.: 517,867

[22] Filed: Jul. 27, 1983

[51] Int. Cl.[4] ..... H01R 25/00

[52] U.S. Cl. ..... 339/47 R; 339/248 S; 339/256 SP; 339/256 R

[58] Field of Search ..... 339/47, 49, 252 R, 252 F, 339/252 S, 253 R, 253 S, 254 R, 254 M, 255 R, 256 R, 256 S, 256 SP, 258 R, 258 S, 148 R, 148 S

[56] References Cited

U.S. PATENT DOCUMENTS

| | | | |
|---|---|---|---|
| 741,052 | 10/1903 | Mahon | 339/252 R |
| 1,210,110 | 12/1916 | Smith | 339/252 R |
| 2,336,517 | 12/1943 | Wade | 339/256 R |
| 2,523,782 | 9/1950 | Sanda | 339/248 |
| 2,814,025 | 11/1957 | Wade et al. | 339/256 SP |
| 3,206,717 | 9/1965 | Brown et al. | 339/256 R |
| 3,208,030 | 9/1965 | Evans et al. | 339/47 R |
| 4,018,497 | 4/1977 | Bulanchuk | 339/255 R |

FOREIGN PATENT DOCUMENTS

| | | | |
|---|---|---|---|
| 193456 | 11/1957 | Fed. Rep. of Germany | 339/248 S |

*Primary Examiner*—Gil Weidenfeld
*Assistant Examiner*—David L. Pirlot
*Attorney, Agent, or Firm*—Allan B. Osborne

[57] ABSTRACT

The present invention relates to an electrical connector capable of transmitting power in high current applications. The connector includes a pivotally mounted spring member which exerts a high spring force against a mating tab terminal or the tab portion of a like connector.

2 Claims, 7 Drawing Figures

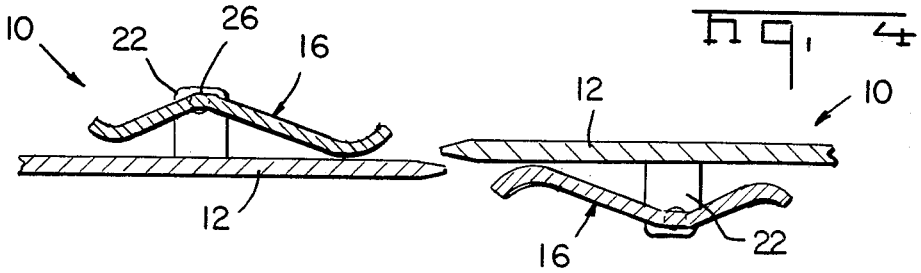
Fig. 4
Fig. 5
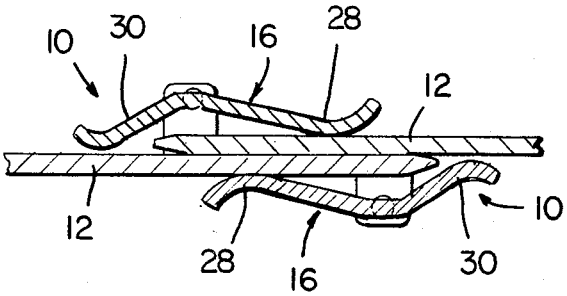
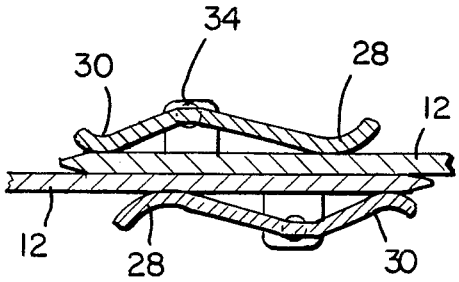
Fig. 6
Fig. 7
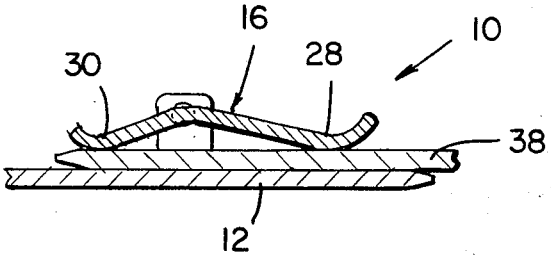

HIGH CURRENT CONNECTOR

BACKGROUND OF THE INVENTION

1. Field of the Invention

The invention disclosed herein is in the field of removably connecting two electrical wires together by means of mating electrical connectors secured to the ends of the wires.

2. Background of the Invention

The present invention is a novel improvement over and a departure from at least the following:

| U.S. Pat. No. | Patentee |
|---|---|
| 741,052 | C. Mahon |
| 3,208,030 | R. T. Evans et al |

Mahon discloses a connector comprising an elongated block of insulating material with a tongue and overlying spring member extending forwardly therefrom. The mating surface of the tongue is shaped to have a convex leading section followed by a concave section. The spring member has a concavo-convex surface with the convex surface facing the tongue. Two like connectors are mated by inserting the tongue of one in between the tongue and spring of the other. The spring members provide both a biasing force against the mating surfaces of the tongue and electrical contact with a conductive plate secured to the opposite side of the tongue against which the spring member (of the other connector) bears.

Evans et al discloses a hermaphroditic type connector on which the spring member is a continuation of the blade. The connector is formed by reverse bending a metal strip twice, first rearwardly to provide a double thickness blade and secondly forwardly to form a leaf spring. The space between the forward ends of the blade and leaf spring provide a receptacle in which the blade of a like connector may be inserted. The leaf springs of the mated connectors are on either side of the two blades so as to bias them together.

SUMMARY OF THE INVENTION

The present invention is an electrical connection having an elongated blade with a spring member pivotally mounted over the plate defining thereby a receptacle to receive a blade of another connector, either of a like kind or of the type having a tab. The spring member includes an elongated front spring arm and a short, rear spring arm with the pivot point between the two arms. As the mating blade is inserted, the longer spring arm, in combination with its associated blade, exerts a low force against the inserting blade. The forces increase substantially as the mating blade passes the pivot point and enters the space between the rear spring arm and the associated blade. The shorter rear arm is not only a strong spring force in its own right but it also levers or pivots the front spring arm down against the inserted blade to increase the compressive force there. Further, the spring arms tend to straighten out. The combined compressive forces provide high blade-to-blade contact for enhanced current transfer therethrough.

BRIEF DESCRIPTION OF THE DRAWINGS

FIGS. 4, 5, and 6 are diagrammatic sectional views illustrating the operativeness of the connectors of the present invention; and FIG. 7 is a diagrammatic sectional view illustrating the operativeness of a connector of the present invention with a tab-type terminal.

DESCRIPTION OF THE INVENTION

Figure 1:
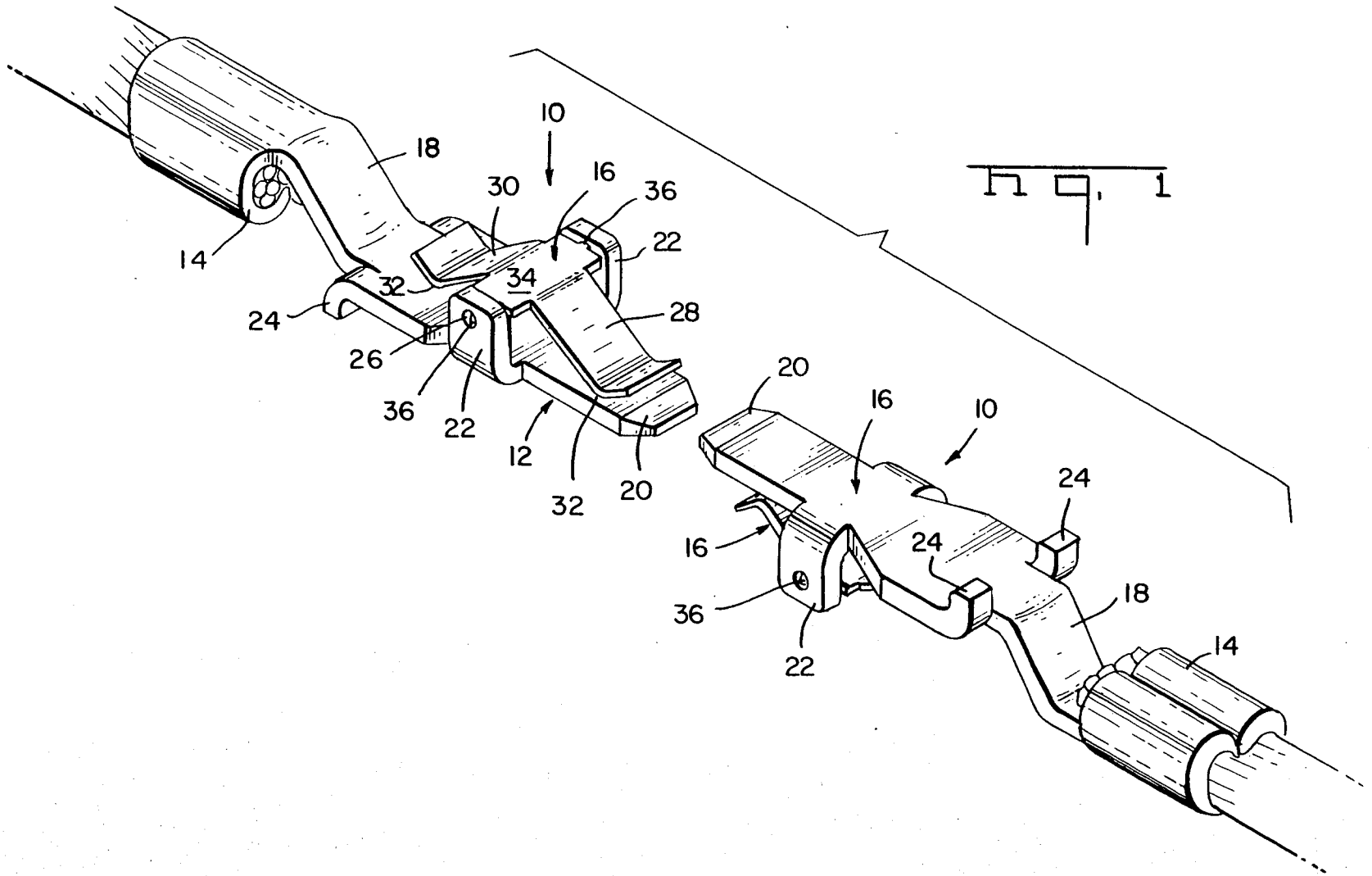
FIG. 1 is an isometric view of two connectors constructed in accordance with the preferred embodiment of the present invention.

Connectors 10 shown in FIG. 1 include an elongated blade 12, wire receiving means; e.g., a U-shaped ferrule 14 and spring member 16. A connecting strap 18 connects the plate to the ferrule.

The blade, strap and ferrule are preferably stamped and formed from copper alloy. Spring member 16 is preferably made from stainless steel.

Blade 12 includes a beveled tip 20, a pair of spring member support brackets 22 and retaining ears 24.

Support brackets 22 extend vertically from the edges of the blade to define in cooperation therewith a yoke-like structure. Each bracket has opening 26 adjacent the upper free end to receive a pin on spring member 16.

Ears 24 extend in a direction opposite to support brackets 22. The ears retain the connector in a housing (not shown).

Connecting strap 18 is bent so that ferrule 14 is vertically offset relative to blade 12. The offset is for the purpose of aligning the ferrule with the blade so that the housing passage (not shown) which receives the connector is greatly simplified.

Ferrule 14 is just one type of wire receiving means which can be used with blade 12.

Spring members 16 include a forwardly projecting, long spring arm 28 and a rearwardly projecting short spring arm 30. The free ends of each arm are formed in a concavo-convex shape with the convex surfaces, indicated by reference numeral 32, facing the blade.

The two arms are joined by bar 34. Pivot pins 36 are attached to the sides of the bar. The spring members are pivotally mounted to support brackets 22 by the pivot pins being received in openings 26.

Figure 2:
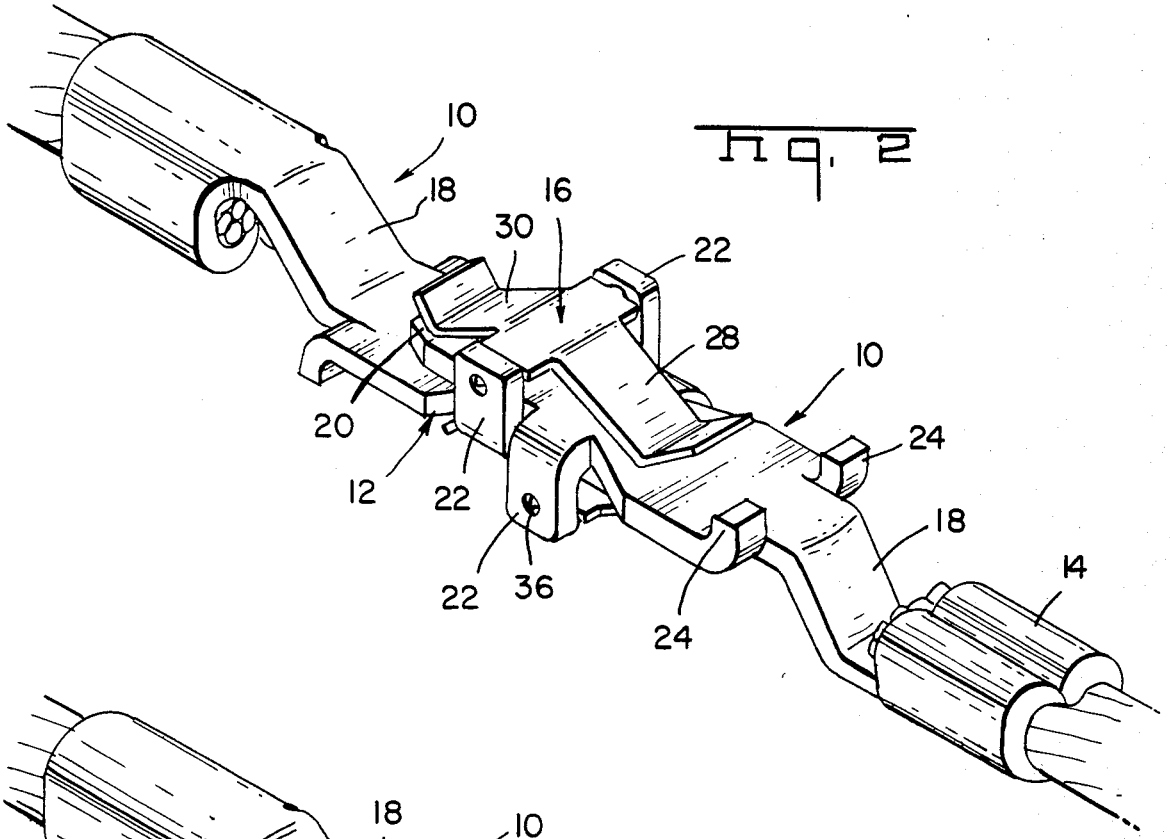
FIG. 2 is an isometric view of the two connectors of FIG. 1 after being mated.

FIG. 1 shows two connectors 10 of identical construction. FIG. 2 shows those two connectors mated together. As suggested by the drawings, each blade slides in between the spring member 16 and associated blade 12. The spring members on both connectors bias the blades together. Support brackets 22 determine the depth of insertion.

Figure 3:
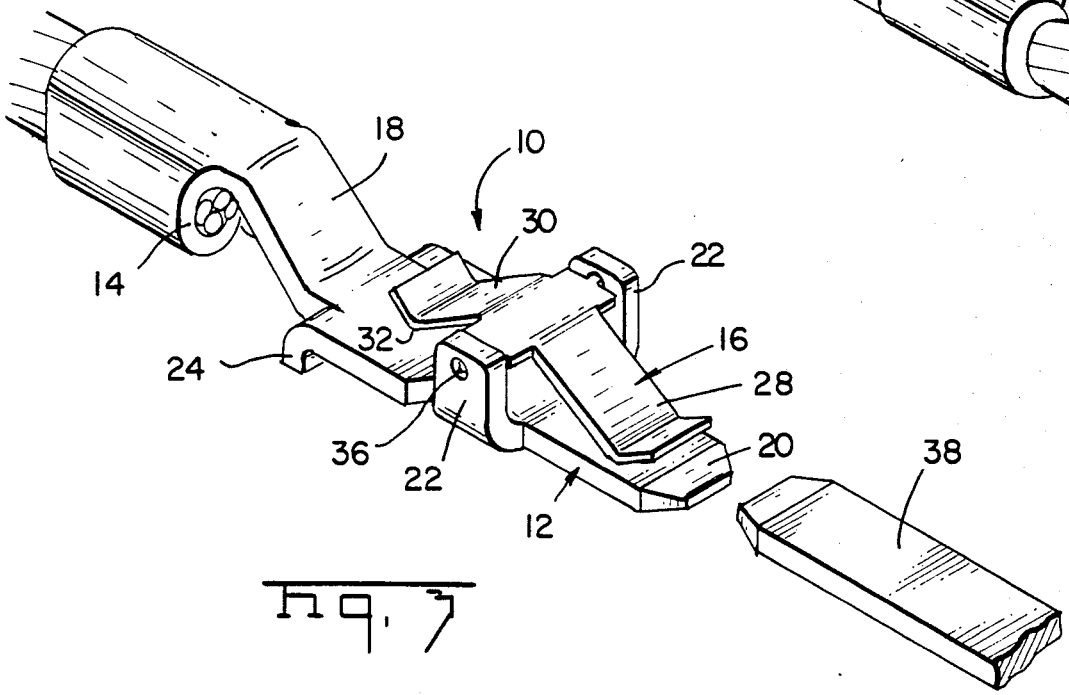
FIG. 3 is an isometric view of one connector of FIG. 1 along with a tab-type terminal.

FIG. 3 demonstrates the fact that a connector 10 can matingly receive a tab terminal 38. The terminal is received in between spring member 16 and blade 12.

FIGS. 4 through 7 illustrate diagrammatically the action of spring member 16. FIG. 4 shows two connectors 10 in alignment for being joined.

FIG. 5 shows each blade being inserted between forwardly projecting long spring arm 28 and the associated blade. The insertion force to this point is low since the spring member has pivoted counterclockwise; i.e., long spring arm 28 has moved away from the blade and short spring arm 30 has moved towards the blade.

FIG. 6 shows the connectors fully inserted. Blades 12 have been pushed in under short spring arm 30. The insertion would force spring members 16 to pivot clockwise; however, the presence of blade 12 under long spring arm 28 prevents that. Accordingly, both arms tend to straighten out. As a result, the second-stage insertion force is high but so is the compressive forces being exerted against the blades. Thus, a good electrical interface between the blades is achieved. Additionally, the high compressive forces prevent the blade from moving and creating fretting corrosion.

FIG. 7 is a diagrammatical cross-sectional view showing that the connector 10 and more particularly, spring member 16 works equally well with tab terminal 38 and in the same manner.

The foregoing detailed description has been given for clearness of understanding only, and no unnecessary limitations should be understood therefrom, as some modifications will be obvious to those skilled in the art.

I claim:

1. An electrical connector, comprising:

a. a strip of conductive material having wire retaining means at a back end and an elongated blade at a front end;

b. support brackets attached to opposite sides of the blade and having free ends extending upwardly therefrom with pin receiving means adjacent the free ends, said brackets defining a yoke-like structure; and c. an elongated spring member having a bar with a pin on each side, said spring member positioned over the blade and in between the brackets with the pins being received in the pin receiving means for pivotally mounting the spring member thereon, said spring member further having a long spring arm attached to the bar and extending towards the front end and obliquely downwardly towards the blade and a short spring arm attached to the bar and extending towards the back end and obliquely downwardly towards the blade, said spring arms and blade defining two separate spaces therebetween for receiving another blade or a tab terminal.

2. The electrical connector of claim 1 wherein free ends of the spring arms are concavo-convex shaped with the convex surface facing the blade.

* * * * *